United States Patent [19]

Pidcock et al.

[11] Patent Number: 4,693,074

[45] Date of Patent: Sep. 15, 1987

[54] COMBUSTION APPARATUS FOR A GAS TURBINE ENGINE

[75] Inventors: Anthony Pidcock; Andrew P. Wray, both of Derby, England

[73] Assignee: Rolls-Royce plc, London, England

[21] Appl. No.: 865,648

[22] Filed: May 16, 1986

Related U.S. Application Data

[63] Continuation of Ser. No. 671,785, Nov. 15, 1984, abandoned.

[30] Foreign Application Priority Data

Nov. 26, 1983 [GB] United Kingdom ..... 8331634

[51] Int. Cl.[4] ..... F02C 1/00; F02G 3/00

[52] U.S. Cl. ..... 60/39.32; 60/740; 60/746; 60/756; 746/756

[58] Field of Search ..... 60/39.31, 39.32, 740, 60/748, 734, 337, 739, 746, 747, 756

[56] References Cited

U.S. PATENT DOCUMENTS

| | | | |
|---|---|---|---|
| 3,618,317 | 11/1971 | Du Bell | 60/748 |
| 3,703,259 | 11/1972 | Sturgess et al. | 60/748 |
| 3,811,278 | 5/1974 | Taylor et al. | 60/748 |
| 3,853,273 | 12/1974 | Bahr et al. | 60/748 |
| 3,866,413 | 2/1975 | Sturgess | 60/748 |
| 3,899,884 | 8/1975 | Ekstedt | 60/748 |
| 3,946,552 | 3/1976 | Weinstein et al. | 60/748 |
| 4,073,134 | 2/1978 | Koch | 60/748 |
| 4,454,711 | 6/1984 | Ben-Porat | 60/39.32 |
| 4,584,834 | 4/1986 | Koshoffer et al. | 60/737 |
| 4,653,278 | 3/1987 | Vinson et al. | 60/737 |

FOREIGN PATENT DOCUMENTS

| | | |
|---|---|---|
| 1297244 | 11/1972 | United Kingdom . |
| 1427146 | 3/1976 | United Kingdom . |
| 1597817 | 9/1981 | United Kingdom . |

OTHER PUBLICATIONS

Le Febvre, Arthur H., *Gas Turbine Combustion,* 9/1983, pp. 8 and 100–102.

*Primary Examiner*—Louis J. Casaregola
*Assistant Examiner*—Timothy S. Thorpe
*Attorney, Agent, or Firm*—Cushman, Darby & Cushman

[57] ABSTRACT

The present invention relates to combustion apparatus for gas turbine engines.

An annular combustion chamber of a gas turbine engine comprises an upstream wall formed from a single metal skin. The upstream wall has a plurality of equi-spaced apertures, and a convergent/divergent pot is positioned coaxially with each aperture and extends in an upstream direction therefrom. Each convergent/divergent pot has a radial swirler assembly positioned a its upstream end to supply air into the convergent/divergent pot. A fuel injector is aligned with each convergent/divergent pot and radial swirler assembly to supply fuel into the convergent/divergent pot. A plurality of annular air scoops extend in an upstream direction from the upstream wall, and each annular air scoop is positioned coaxially around a convergent/divergent pot to supply air to the radial swirler assembly. The downstream end of each convergent/divergent pot has apertures for supplying cooling air over the downstream face of the upstream wall.

16 Claims, 15 Drawing Figures

COMBUSTION APPARATUS FOR A GAS TURBINE ENGINE

This is a continuation of application Ser. No. 671,785, filed Nov. 15, 1984 which was abandoned upon the filing hereof.

The present invention relates to combustion apparatus for gas turbine engines, and is particularly concerned with the upstream wall of the combustion apparatus.

The invention is intended to simplify the upstream wall of combustion apparatus which use airspray fuel injectors, so as to reduce weight and cost. The invention is also intended to provide convective cooling of the upstream wall without the use of a double skinned upstream wall.

Accordingly the present invention provides annular combustion equipment for a gas turbine engine comprising an inner annular wall, an outer annular wall and an upstream wall forming part of a dump diffuser, the upstream wall comprising a single skin convectively cooled by air passing over its upstream surface, the upstream wall having a plurality of circumferentially arranged equi-spaced apertures, a convergent/divergent pot being positioned coaxially with each aperture, each convergent/divergent pot being secured at its downstream end to the upstream wall and extending in an upstream direction therefrom, each convergent/divergent pot having a radial swirler positioned at its upstream end to supply air into the convergent/divergent pot and corresponding radial swirler assembly to supply fuel into the convergent/divergent pot, an annular air scoop being positioned coaxially around each convergent/divergent pot, each annular air scoop being secured to and extending in an upstream direction from the upstream wall, an annular chamber being formed between each convergent/divergent pot and the corresponding annular air scoop, each convergent/divergent pot having a plurality of apertures arranged in a ring at its downstream end for supplying cooling air from the annular chamber over the downstream face of the upstream wall, the annular air scoops supplying air to the radial swirlers and to the annular chambers.

The upstream wall may have a curved cross-section and the downstream end of each convergent/divergent pot is curved to correspond to the curving of the upstream wall.

The downstream wall may have a flat cross-section an the downstream end of each convergent/divergent pot is flat to correspond to the upstream wall.

The divergent portion of the convergent/divergent pot may be of circular cross section and or conical.

The divergent portion of the convergent/divergent pot may have internal chambers supplied with cooling air from the annular chamber for cooling the pot.

A second radial swirler assembly may be positioned coaxially with and axially between the convergent/divergent pot and the first radial swirler assembly, and an annular lip is positioned between the first and second swirler assemblies and extends radially inwards and in a downstream direction into the convergent/divergent pot, the fuel injector and the first radial swirler assembly supply fuel and air in the convergent/divergent pot through the annular lip, and the second radial swirler assembly supplies air into the convergent/divergent pot and the annular lip deflects the air from the second radial swirler assembly to flow over the convergent/divergent pot to prevent fuel depositing on the convergent/divergent pot.

The upstream end of each annular air scoop may be positioned upstream of the or each corresponding radial swirler assembly to supply air to the or each radial swirler assembly and annular chamber.

The fuel injectors may be airspray fuel injectors. The fuel injectors may be located coaxially with the convergent/divergent pot and the radial swirler assembly by locating means which allow relative movement of the fuel injector and convergent/divergent pot axially, radially and circumferentially to limit the transmission of loads to the fuel injector.

The fuel injectors may have a partially spherical outer surface.

The locating means may comprise a ring having a T section which abuts the partially spherical outer surface of the fuel injector, the stem of the T section ring extends into a slot formed between the upstream end of the radial swirler assembly and an annular member secured to and positioned coaxially with the radial swirler assembly.

The locating means may comprise a ring having a T section and a split ring having a partially spherical inner surface, and the split ring being positioned coaxially within and abutting the T section ring and the partially spherical inner surface of the split ring abutting the partially spherical outer surface of the fuel injector, the stem of the T section ring extending into a slot formed between the upstream end of the radial swirler assembly and an annular member secured to and positioned coaxially with the radial swirler assembly.

The locating means may comprise a ring having a partially spherical outer surface which fits coaxially around the fuel injector, a pair of L section rings which have partially spherical inner surfaces which abut the partially spherical outer surface of the ring, the L section rings are positioned back to back and extend into a slot formed between the upstream end of the radial swirler assembly and an annular member secured to and positioned coaxally with the radial swirler assembly.

The present invention will be more fully described by way of example and with reference to the accomapnying drawings in which.

Figure 1:
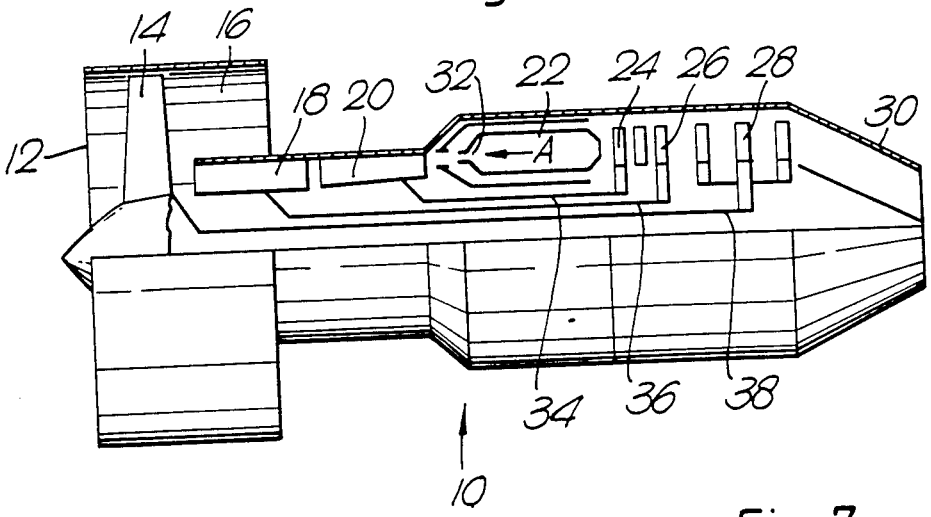
FIG. 1 is a partly broken away view of a gas turbine engine showing annular combustion equipment according to the present invention.

In FIG. 1 there is shown a gas turbine engine 10 comprising an inlet 12, a fan 14, intermediate and high pressure compressors 18 and 20 respectively, an annular combustion chamber 22, high, intermediate and low pressure turbines 24, 26 and 28 respectively and a thrust nozzle 30. In operation air flows into the inlet 12 and is initially compressed by the fan 14. The majority of the air flows through an annular bypass duct 16 to provide thrust. The remainder of the air is further compressed by the intermediate and high pressure compressors 18 and 20 before being supplied to the annular combustion chamber 22. Fuel is injected into the annular combustion chamber 22, and is burnt in the air to produce hot gases which flow through, and drive the high, intermediate and low pressure turbines 24, 26 and 28 respectively before flowing through the thrust nozzle 30 to provide more thrust. The high, intermediate and low pressure turbines 24, 26 and 28 drive the high and intermediate compressors 20 and 18 respectively and the fan 14 via shafts 34, 36 and 38 respectively.

The annular combustion chamber 22 has an upstream wall 32 which is shown more clearly in FIGS. 2 to 5. The annular combustion chamber 22 comprises an inner annular wall 42 and an outer annular wall 44, both of which have apertures 46 and 48 respectively for supplying cooling air onto the inner surfaces of the annular walls 42 and 44. The apertures 46 and 48 are arranged in rings around the inner and outer annular walls 42 and 44 respectively to form cooling air films over the inner surfaces of the annular walls 42 and 44. The annular walls 42 and 44 could also have lips adjacent to the rings of cooling apertures. The upstream wall 32 is formed from a single metal skin and has a plurality of equispaced apertures 50 therethrough. A convergent/divergent pot 52 is positioned coaxially with each aperture 50, and each convergent/divergent pot 52 extends in an upstream direction from the upstream wall 32. A radial swirler assembly 54 is positioned at the upstream end of each convergent/divergent pot 52 to supply air into the convergent/divergent pot 52, and a fuel injector 56 is aligned with and usually positioned coaxially with the pot 52 and the radial swirler assembly 54 and supplies fuel into the convergent/divergent pot 52. Each of the convergent/divergent pots 52 has an annular air scoop 58 which is positioned coaxially around the convergent-/divergent pot 52, and which extends in an upstream direction from the upstream wall 32. An annular chamber 60 is formed between each convergent/divergent pot 52 and its associated air scoop 58, and each pot 52 has apertures 68 at its downstream end to supply air from the annular chamber 60 onto the inner surface of the upstream wall 32. An annular member 62 which has an L shaped cross-section is secured to the upstream end of the radial swirler assembly 54, and locating rings 64 fit into slots 61 formed between the annular members 62 and the upstream end of the swirler assembly 54. The locating rings 64 extend to the fuel injectors 56 and seal off the upstream end of the pot/swirler assembly, but allow relative axial, radial and circumferential movement between the fuel injectors 56 and the pots 52 and combustion chamber 22. Each fuel injector 56 is supplied with fuel from a fuel feed arm 66, and the fuel injectors 56 are preferably airspray fuel injectors which have a small diameter and which require relatively small access holes in the casing. Other fuel injector with small diameters could be used.

In operation air is supplied from the high pressure compressor 20 to the annular combustion chamber 22. Primary air flows through the radial swirler assemblies 54 into the convergent/divergent pots 52 and through the apertures 50 into the annular combustion chamber 22. A portion of the primary air flows through the airspray fuel injectors 56 into the convergent/divergent pots 52, and fuel is injected into the portion of the primary air. The portion of primary air and fuel flows into the convergent/divergent pots 52, and the swirling primary air flowing into the convergent/divergent pots 52 from the radial swirler assemblies 54 causes the fuel to be atomised and mixed with the primary air before flowing through the apertures 50 into the annular combustion chamber 22. The annular air scoops 58 ensure air is supplied to the radial swirler assemblies 54, and also to the annular chambers 60 formed between the scoops 58 and the pots 52. The annular chambers 60 supply cooling air through apertures 68, which form a ring at the downstream end of the pot 52, and over the downstream surface of the upstream wall 32 as shown by arrows D in FIG. 2.

The remaining air passes over the upstream surface of the single skin upstream wall 32, round the scoops 58, to provide convective cooling of the upstream wall 32. The air is then metered through the rings of apertures 46 and 48 in the inner annular wall 42 and outer annular wall 44 respectively to flow over the inner surface of the inner and outer annular walls 42 and 44 respectively to form cooling air films, and some of the air flows through dilution apertures (not shown) in the inner and outer annular walls 42 and 44 respectively.

Figure 3:
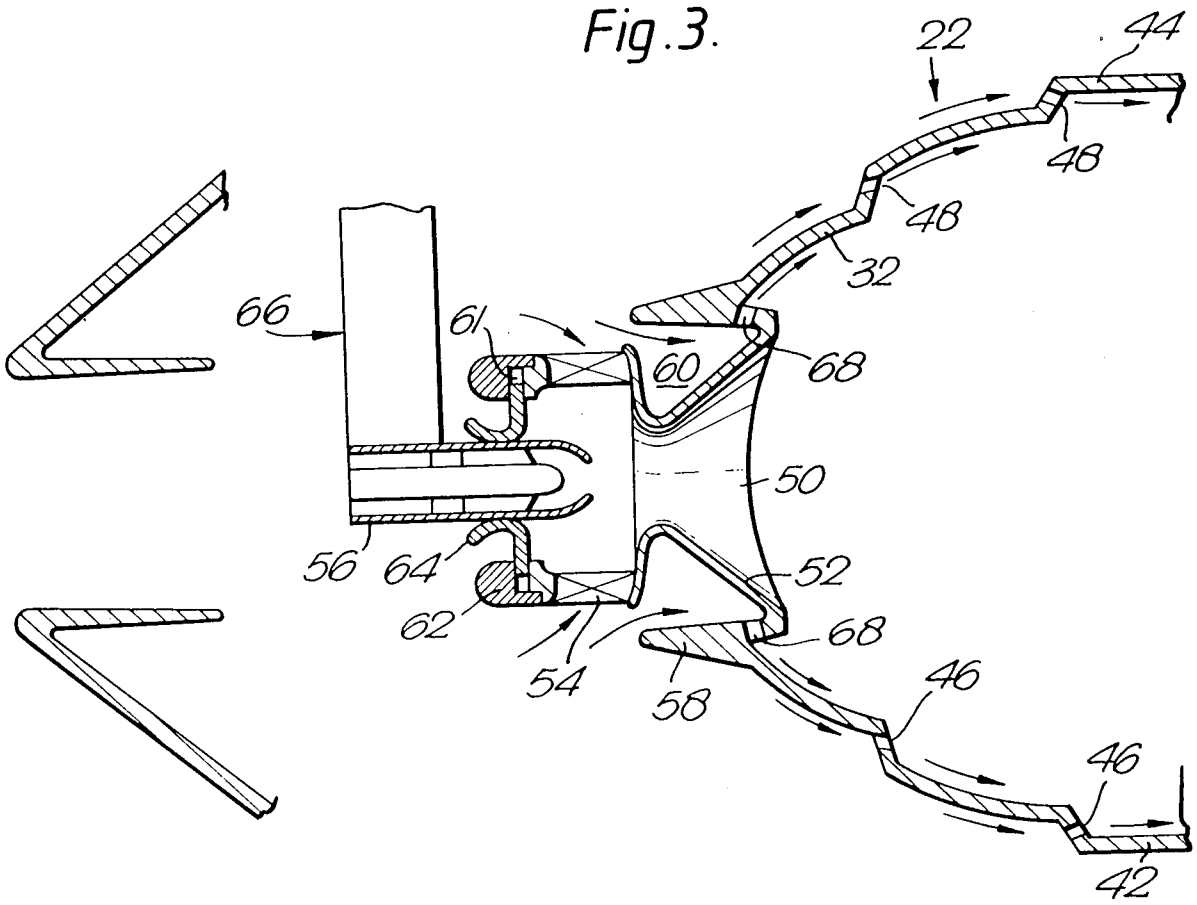
FIG. 3 is a sectional view looking along line B—B in FIG. 2.
Figure 5:
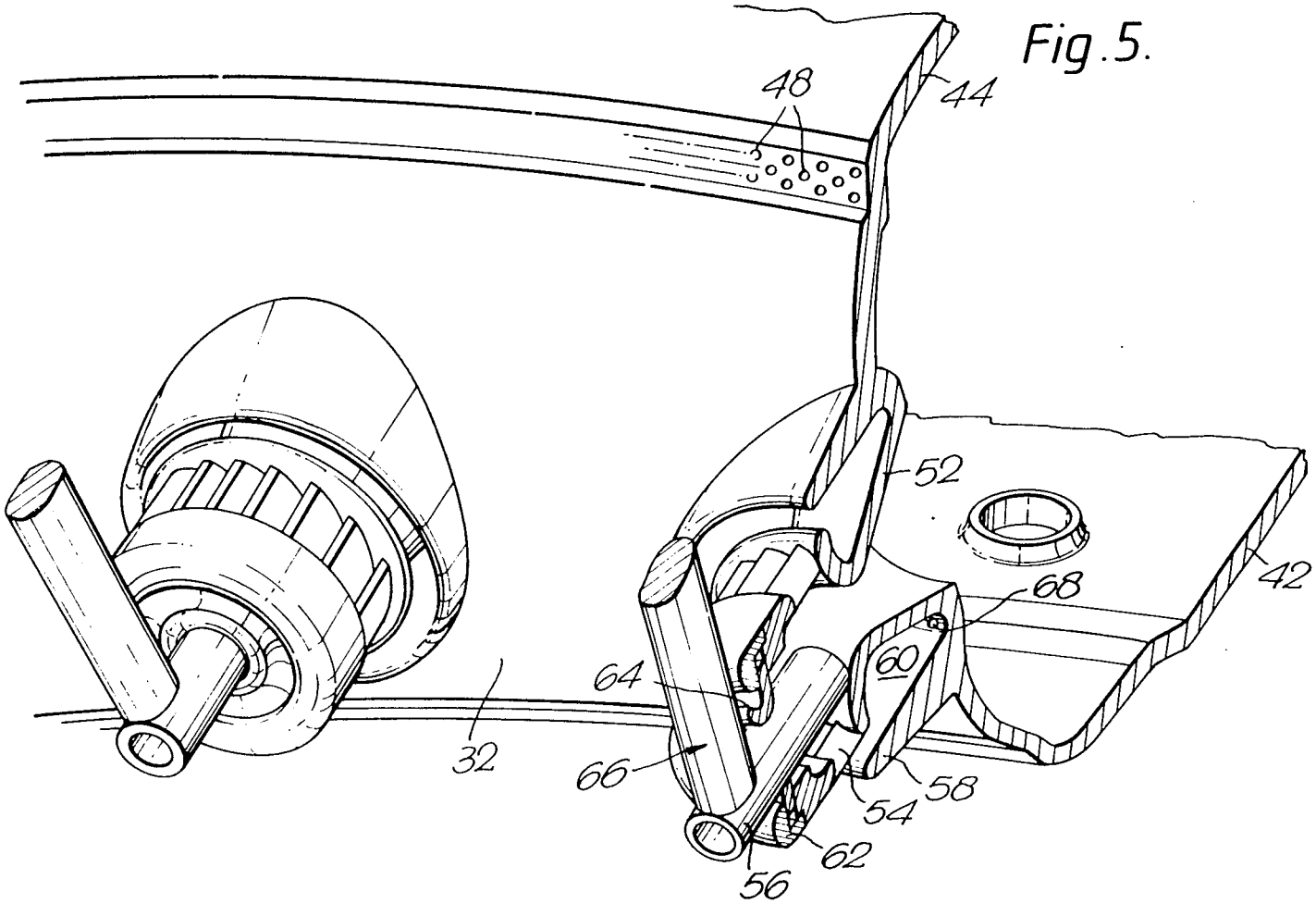
FIG. 5 is a perspective view of the annular combustion equipment.

The upstream wall 32 forms part of a dump diffuser, and it is preferable to use a curved shape as shown in FIG. 3 so as to minimise the parasitic pressure loss in the diffuser. The curved upstream wall 32 leads to the use of a curved downstream end for the convergent/divergent pots 52 which decrease combustion performance.

Figure 4:
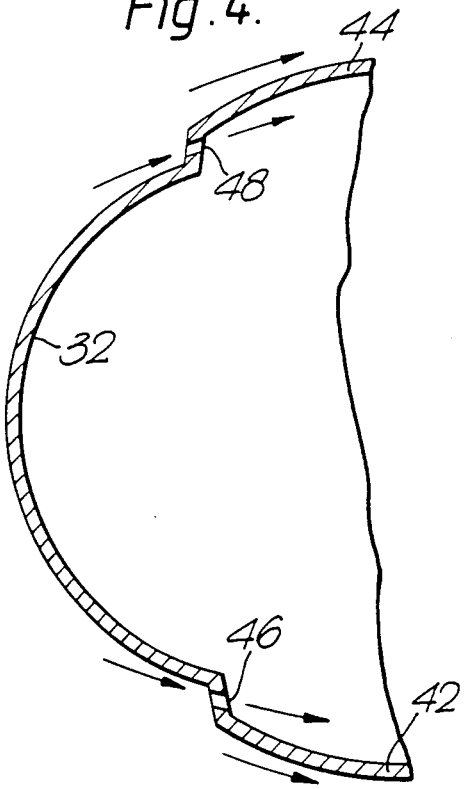
FIG. 4 is a sectional view looking along line C—C in FIG. 2.
Figure 7:
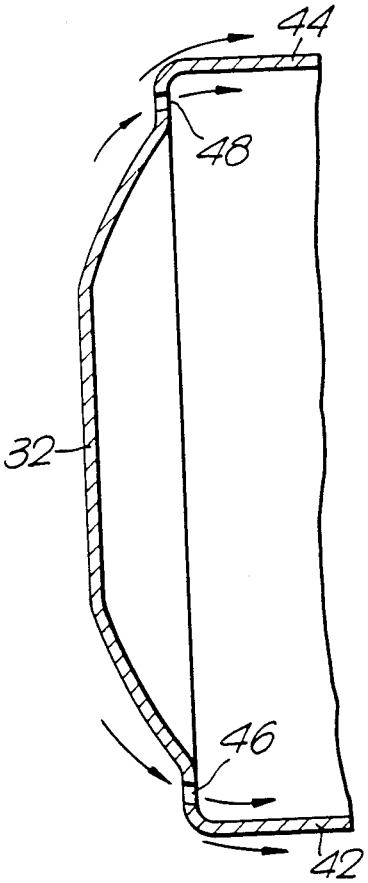
FIG. 7 is a sectional view similar to FIG. 4 showing an alternative embodiment.
Figure 2:
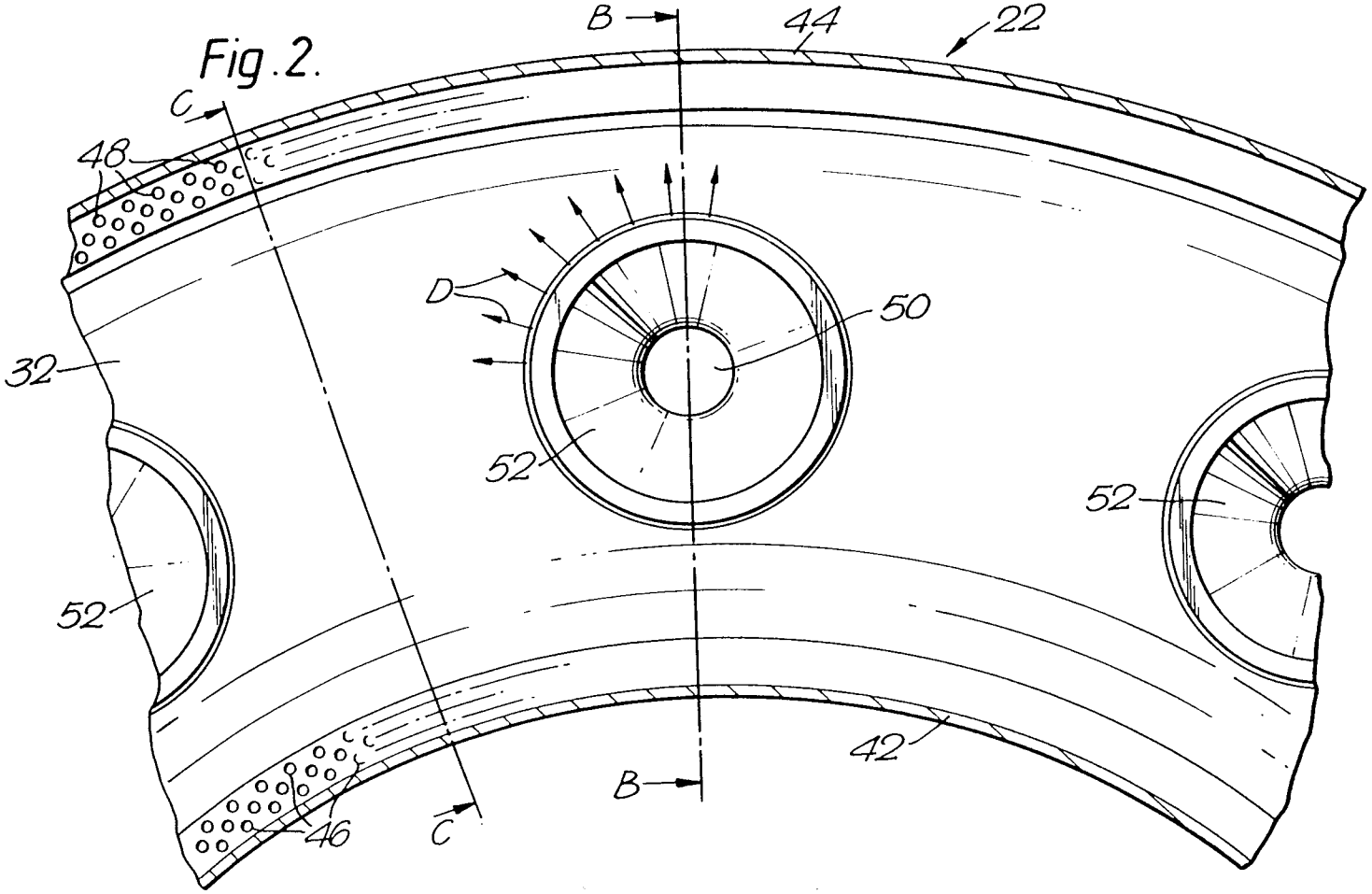
FIG. 2 is an enlarged view in the direction of arrow A in FIG. 1.
Figure 6:
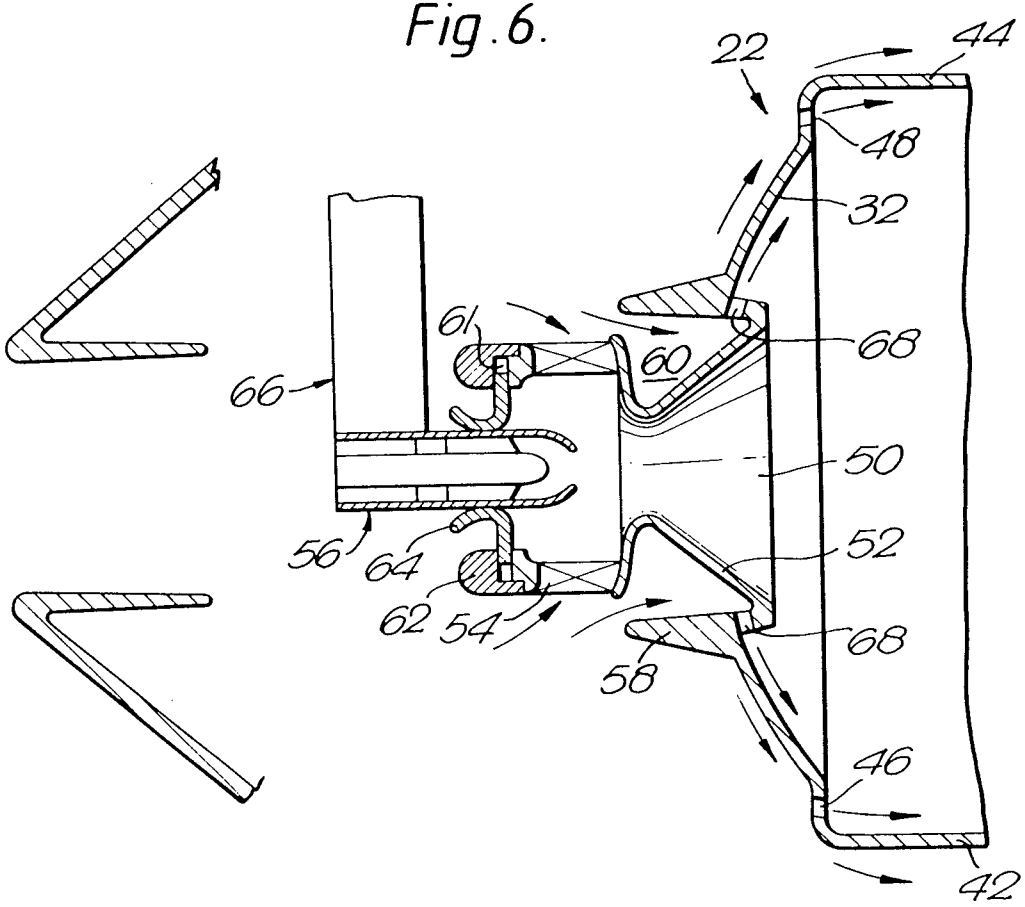
FIG. 6 is a sectional view similar to FIG. 3 showing an alternative embodiment.

FIGS. 6 and 7 are views similar to FIGS. 3 and 4 but show an alternative embodiment of the upstream wall 32 which is flat, and which increases the parasitic pressure loss of the diffuser. The downstream ends of the convergent/divergent pots 52 are flat and they increase combustion efficiency. The shapes of the upstream wall 32 and downstream ends of the pots 52 are chosen to give the best overall compromise between diffuser pressure loss and combustion performance loss.

Figure 8:
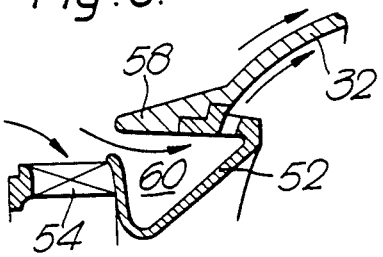
FIG. 8 shows one pot configuration according to the invention.
Figure 9:
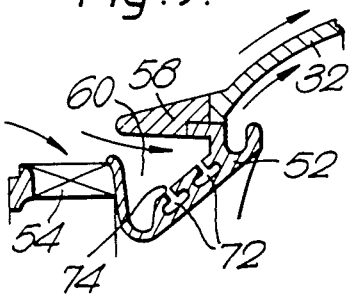
FIG. 9 shows an alternative pot configuration according to the invention.
Figure 10:
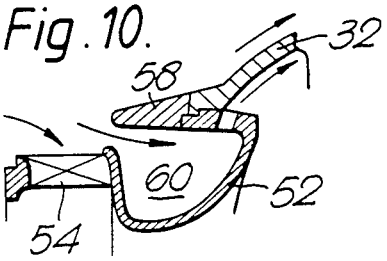
FIG. 10 shows a further pot configuration according to the invention.

FIGS. 8 to 11 show alternative pot configurations which may be employed. FIG. 8 shows a pot 52 identical to the one in FIG. 3, in which the divergent portion is conical and the annular scoop 58 may be provided with a thread on its inner surface and the pot 52 may be provided with a thread on its outer surface. The scoops 58 can then be screwed onto the pots 52, and the upstream wall 32 is clamped between the scoops 58 and pots 52. FIG. 9 shows a pot 52 in which the divergent portion has internal chambers 72 supplied with cooling air from annular chamber 60 through apertures 74 in the pot 52. The cooling air provides impingement and convective cooling of the pot 52. The pot 52 in FIG. 10 is not conical but has a circular cross-section and is flared at its divergent portion to maximise the size of the flow reversal in the annular combustion chamber 22 and can be used to reduce the axial length of the pot 52.

Figure 11:
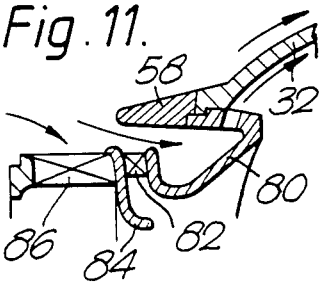
FIG. 11 shows another embodiment of the pot according to the invention.

FIG. 11 shows the use of two radial swirlers 86 and 82 which have an annular lip 84 positioned between them, and which are positioned at the upstream end of the convergent/divergent pot 80. The annular lip 84 extends radially inwards and in downstream direction into the convergent/divergent pot and directs air from the swirler 82 over the inner surface of the pot 80 to prevent fuel flowing through the annular lip 84 being deposited onto the surface of the pot 80.

Figure 12:
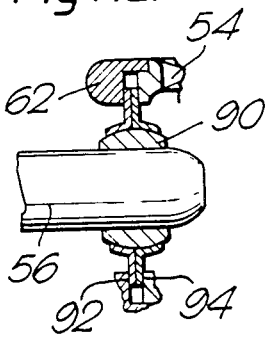
FIG. 12 shows one fuel injector location.
Figure 13:
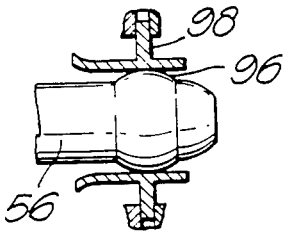
FIG. 13 shows an alternative fuel injector location.
Figure 14:
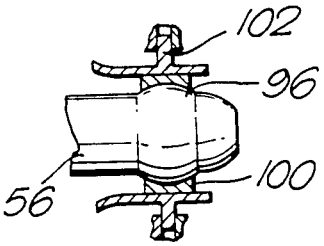
FIG. 14 shows a further fuel injector location.

FIGS. 12 to 14 show fuel injector locating arrangements, and FIG. 12 shows the fuel injector 56 positioned coaxially within a ring 90 which has a partially spherical outer surface. The ring 90 is supported from the annular member 62 and the upstream end of the swirler assembly 54 by a pair of L section rings 92 and 94 which are placed back to back and which have partially spherical inner surfaces which abut the partially spherical outer surface of the ring 90, and the rings 92 and 94 extend intothe slot formed between the annular member 62 and swirler assembling 54. The fuel injector 56 is free to move axially through the ring 90 to allow for relative axial movement of the combustion chamber 22 and fuel injector 56, and the rings 92 and 94 allow relative radial and circumferential movement.

The fuel injectors 56 in FIGS. 13 and 14 have partially spherical outer surfaces 96, and in FIG. 13 a ring 98 of T section abuts the spherical surface 96 of the fuel injector 56. The stem of the T fits into the slot formed between the swirler assembly 54 and the annular member 62. In FIG. 14 a T section ring 102 fits into the slot formed between the swirler assembly 54 and the annular member 62, and a split ring 100 which has a partially spherical inner surface fits onto the partially spherical outer surface 96 of the fuel injector 56. The split ring 100 is positioned coaxially within the T section ring 102. These embodiments also allow relative axial, radial and circumferential movement between the fuel injector 56 and the annular combustion chamber 22 so that no excessive mechanical loads are transmitted to the fuel injectors 56.

The fuel injectors 56 are intended to be positioned coaxially with the convergent/divergent pots 52, but the locating arrangements allow relative movement between the fuel injectors 56 and combustion chamber 22, as mentioned above, so the fuel injectors may not always be coaxial with the pots but are always aligned therewith.

Figure 15:
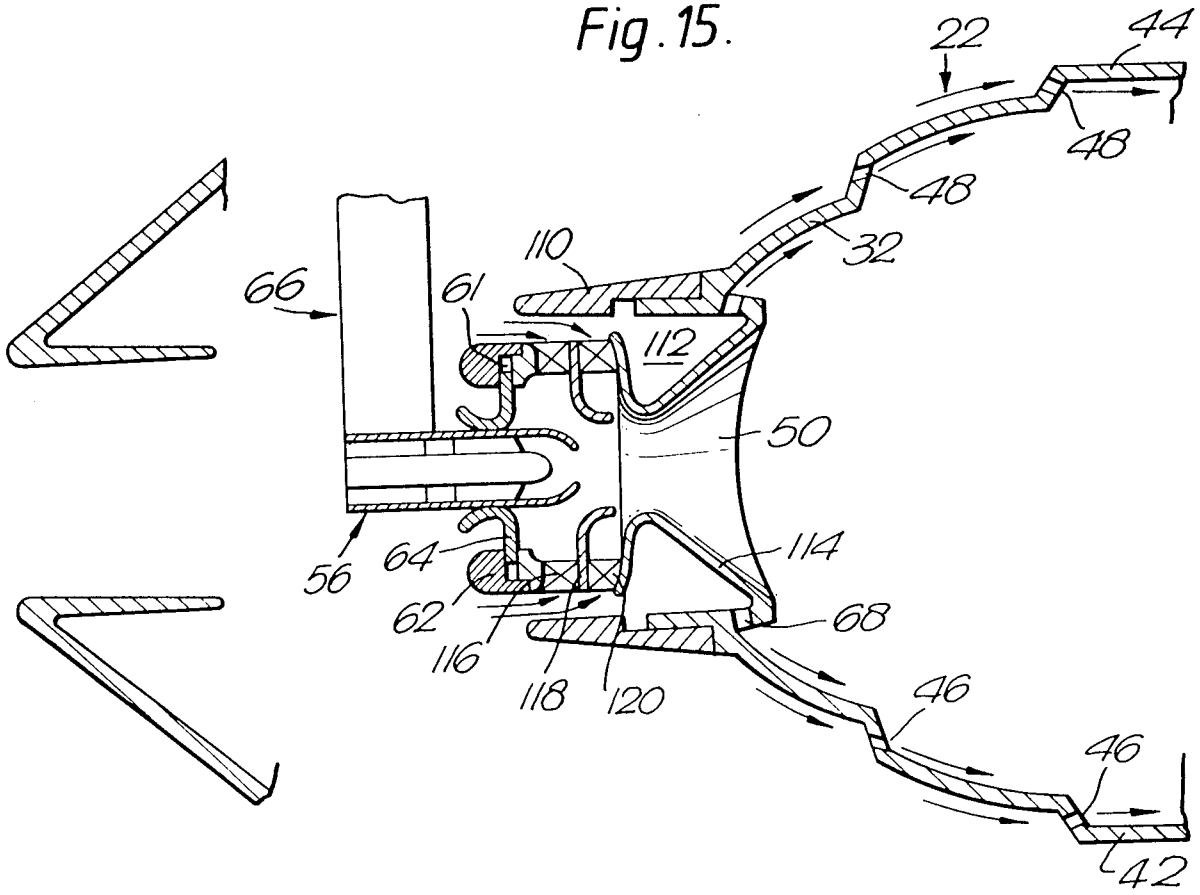
FIG. 15 is a sectional view similar to FIG. 3 showing a further embodiment.

FIG. 15 is a sectional view similar to FIG. 3 but has a pot configuration similar to FIG. 11. A convergent-/divergent pot 114 has two radial swirler assemblies 116 and 120 positioned at its upstream end, and an annular lip 118 is positioned axially between the radial swirlers 116 and 120. The annular lip 118 extends radially inwards and in a downstream direction into the convergent/divergent pot 114 to direct air from the radial swirler 120 over the inner surface of the pot 114 to prevent fuel flowing through the annular lip 118 being deposited onto the inner surface of the pot 114.

An annular scoop 110 is positioned coaxially around each convergent/divergent pot 114 and its associated radial swirler assemblies 116 and 120. The annular scoops 110 extend in an upstream direction from the upstream wall 32 so that the upstream end of each annular scoop 110 is positioned upstream of the radial swirlers 116 and 120 to ensure that air is positively supplied to the radial swirlers 116 and 120, and to an annular chamber 112 formed between each pot 114 and the associated annular scoop 110. The annular scoops 110 could be applied to the convergent/divergent pots with a single radial swirler, so that the upstream end of the annular scoop is positioned upstream of the radial swirler assembly.

The single skin upstream wall is cooled by convection, due to the flow of cooling and dilution air passing directly over the upstream suface of the upstream wall. The upstream wall is also cooled by the flow of cooling air flowing over the downstream surface of the upstream wall, which is supplied through apertures in the pot from the annular chamber formed between the pot and the annular scoop. This provides good cooling of the upstream wall without the use of complex double skinned upstream walls which are also heavy.

The airspray fuel injectors can have small diameters which have the advantages of minimising the size of the apertures in the engine casing and reducing the weight of the injectors.

We claim:

1. Annular combustion equipment for a gas turbine engine comprising an inner annular wall, an outer annular wall and an upstream wall, the upstream wall comprising a single skin and forming part of a dump diffuser, the upstream wall being convectively cooled by cooling and dilution air supplied from the dump diffuser passing over the upstream surface of the upstream wall, the upstream wall having a plurality of circumferentially arranged equi-spaced apertures, each aperture having a convergent/divergent pot positioned coaxially therewith, each convergent/divergent pot being secured at its downstream end to the upstream wall and extending in an upstream direction therefrom, each convergent-/divergent pot having a radial swirler assembly positioned coaxially at its upstream end to supply primary air through the convergent/divergent pot into the combustion equipment, each convergent/divergent pot having a fuel injector aligned therewith to supply fuel through the convergent/divergent pot into the combustion equipment, each convergent/divergent pot having an annular air scoop positioned coaxially around the convergent/divergent pot and each annular air scoop being secured to and extending in an upstream direction from the upstream wall, and having an annular upstream end positioned axially adjacent to said radial swirler assembly, an annular chamber being formed between each convergent/divergent pot and the corresponding annular air scoop, each convergent/divergent pot having a plurality of apertures arranged in a ring at its downstream end for supplying cooling air from the annular chamber over the downstream face of the upstream wall, each annular air scoop supplying primary air to the radial swirler assembly of the respective convergent/divergent pot and cooling air to the respective annular chamber, a plurality of said annular air scoops being provided in a circumferentially spaced relation to each other such that the upstream wall between adjacent air scoops is convectively cooled by cooling and dilution air passing over the upstream surface of the upstream wall.

2. Annular combustion equipment for a gas turbine engine as claimed in claim 1 in which the upstream wall has a curved cross-section, the downstream end of each convergent/divergent pot is curved to correspond to the curving of the upstream wall.

3. Annular combustion equipment for a gas turbine engine as claimed in claim 1 in which the upstream wall is flat in cross-section, the downstream end of each convergent/divergent pot is flat to correspond to the upstream wall.

4. Annular combustion equipment for a gas turbine engine as claimed in claim 1 in which the divergent portion of the convergent/divergent pot has a circular cross-section.

5. Annular combustion equipment for a gas turbine engine as claimed in claim 4 in which the divergent portion of the convergent/divergent pot is conical.

6. Annular combustion equipment for a gas turbine engine as claimed in claim 1 in which the divergent portion of the convergent/divergent pot has internal chambers supplied with cooling air from the annular chamber for cooling of the pot.

7. Annular combustion equipment for a gas turbine engine as claimed in claim 1 in which a second radial swirler assembly is positioned coaxially with and axially between the convergent/divergent pot and the first radial swirler assembly, and an annular lip is positioned between the first and second swirler assemblies and extends radially inwards and in a downstream direction into the convergent/divergent pot, the fuel injector and the first radial swirler assembly supply fuel and air into the convergent/divergent pot through the annular lip, and the second radial swirler assembly supplies air into the convergent/divergent pot and the annular lip deflects air from the second radial swirler assembly to flow over the convergent/divergent pot to prevent fuel depositing onthe convergent/divergent pot.

8. Annular combustion equipment for a gas turbine engine as claimed in claim 1 in which the upstream end of each annular air scoop is positioned upstream of the or each corresponding radial swirler assembly to supply air to the or each radial swirler assembly and annular chamber.

9. Annular combustion equipment for a gas turbine engine as claimed in claim 1 in which the fuel injectors are located coaxially with the convergent/divergent pot and radial swirler assembly by locating means which allows relative movement of the fuel injector and the convergent/divergent pot axially, radially and circumferentially to limit the transmission of loads to the fuel injector.

10. Annular combustion equipment for a gas turbine engine as claimed in claim 9 in which the fuel injectors have partially spherical outer surfaces.

11. Annular combustion equipment for a gas turbine engine as claimed in claim 10 in which the locating means comprises a ring having a T section which abuts the partially spherical outer surface of the fuel injector, the stem of the T section ring extending into a slot formed between the upstream end of the radial swirler assembly and an annular member secured to and positioned coaxially with the radial swirler assembly.

12. Annular combustion equipment for a gas turbine engine as claimed in claim 10 in which the locating means comprises a ring having a T section and a split ring having a partially spherical inner surface, the split ring being positioned coaxially within and abutting the T section ring and the partially spherical inner surface of the split ring abutting the partially spherical outer surface of the fuel injector, the stem of the T section ring extending into a slot formed between the upstream end of the radial swirler assembly and an annular member secured to and positioned coaxially with the radial swirler assembly.

13. Annular combustion equipment for a gas turbine engine as claimed in claim 9 in which the locating means comprises a ring having a partially spherical outer surface which fits coaxially around the fuel injector, a pair of L section rings which have partially spherical inner surfaces which abut the partially spherical outer surface of the ring, the L section rings being positioned back to back and extending into a slot formed between the upstream end of the radial swirler assembly and an annular member secured to and positioned coaxially with the radial swirler assembly.

14. Annular combustion equipment for a gas turbine engine as claimed in claim 1 in which the fuel injector is an airspray fuel injector.

15. Annular combustion equipment for a gas turbine engine as claimed in claim 1 wherein each annular air scoop has an annular upstream end positioned upstream of the radial swirler assembly of each convergent/divergent pot, said annular upstream end of each annular air scoop being positioned axially adjacent the upstream end of the radial swirler assembly.

16. Annular combustion equipment for a gas turbine engine comprising an inner annular wall, an outer annular wall and an upstream wall, the upstream wall comprising a single skin and forming part of a dump diffuser, the upstream wall being convectively cooled by cooling and dilution air supplied from the dump diffuser passing over the upstream surface of the upstream wall, the upstream wall having a plurality of circumferentially arranged equi-spaced apertures, each aperture having a convergent/divergent pot positioned coaxially therewith, each convergent/divergent pot being secured at its downstream end to the upstream wall and extending in an upstream direction therefrom, each convergent/divergent pot having a radial swirler assembly positioned coaxially at its upstream end to supply primary air through the convergent/divergent pot into the combustion equipment, each convergent/divergent pot having a fuel injector aligned therewith to supply fuel through the convergent/divergent pot into the combustion equipment, each convergent/divergent pot having an annular air scoop positioned coaxially around the convergent/divergent pot and each annular air scoop being secured to and extending in an upstream direction from the upstream wall, the annular upstream end of each annular air scoop being positioned axially adjacent the downstream end of the radial swirler assembly, an annular chamber being formed between each convergent/divergent pot and the corresponding annular air scoop, each convergent/divergent pot having a plurality of apertures arranged in a ring at its downstream end for supplying cooling air from the annular chamber over the downstream face of the upstream wall, each annular air scoop supplying primary air to the radial swirler assembly of the respective convergent/divergent pot and cooling air to the respective annular chamber.

* * * * *